US011083924B2

(12) United States Patent
Borisoff et al.

(10) Patent No.: US 11,083,924 B2
(45) Date of Patent: Aug. 10, 2021

(54) ACTIVE ARM PASSIVE LEG EXERCISE MACHINE WITH GUIDED LEG MOVEMENT

(71) Applicant: British Columbia Institute of Technology, Burnaby (CA)

(72) Inventors: Jaimie Borisoff, Burnaby (CA); Rory Dougall, Burnaby (CA); Ernst Janzen, Burnaby (CA); Johanne Mattie, Burnaby (CA)

(73) Assignee: British Columbia Institute of Technology, Burnaby (CA)

( * ) Notice: Subject to any disclaimer, the term of this patent is extended or adjusted under 35 U.S.C. 154(b) by 65 days.

(21) Appl. No.: 16/372,754

(22) Filed: Apr. 2, 2019

(65) Prior Publication Data

US 2019/0308054 A1 Oct. 10, 2019

Related U.S. Application Data

(60) Provisional application No. 62/652,947, filed on Apr. 5, 2018.

(51) Int. Cl.
*A63B 21/00* (2006.01)
*A63B 23/035* (2006.01)
(Continued)

(52) U.S. Cl.
CPC ..... *A63B 21/00178* (2013.01); *A61G 5/14* (2013.01); *A61H 1/0262* (2013.01);
(Continued)

(58) Field of Classification Search
CPC ..... A63B 21/00178; A63B 22/001; A63B 22/0664; A63B 69/0057; A63B 21/00181;
(Continued)

(56) References Cited

U.S. PATENT DOCUMENTS 5,207,622 A * 5/1993 Wilkinson ..... A63B 22/0012 482/118
5,792,027 A * 8/1998 Gvoich ..... A63B 22/001 482/51

(Continued)

FOREIGN PATENT DOCUMENTS

EP 2914230 9/2015
FR 3055798 3/2018

*Primary Examiner* — Garrett K Atkinson
(74) *Attorney, Agent, or Firm* — Ryan W. Dupuis; Kyle R. Satterthwaite; Ade & Company Inc.

(57) ABSTRACT

An exercise machine has a main frame, two base link members supported for cyclical movement on base tracks on the main frame, two handles pivotal about a handle axis on the frame in which the handles are operatively connected to the base link members respectively such that a cyclical movement of the handles drives the cyclical movement of the respective base link members, a foot support carried on each base link member for supporting a respective foot of the user thereon through a walking motion of the user as the base link members are moved cyclically, a torso support on the main frame supporting a torso of the user thereon having one or more degrees of freedom relative to the main frame, and leg linkages connected between the main frame and respective ones of the base link members with bracing to secure legs of the user therein.

24 Claims, 6 Drawing Sheets

(51) Int. Cl.

| | |
|---|---|
| ***A63B 22/00*** | (2006.01) |
| ***A63B 22/06*** | (2006.01) |
| ***A61G 5/14*** | (2006.01) |
| ***A63B 69/00*** | (2006.01) |
| ***A61H 1/02*** | (2006.01) |
| ***A63B 22/14*** | (2006.01) |
| ***A63B 22/20*** | (2006.01) |
| ***A63B 22/16*** | (2006.01) |
| ***A61H 3/00*** | (2006.01) |
| ***A63B 21/22*** | (2006.01) |
| ***A63B 21/005*** | (2006.01) |

(52) U.S. Cl.

CPC .... *A63B 21/00181* (2013.01); *A63B 21/4009* (2015.10); *A63B 21/4011* (2015.10); *A63B 21/4015* (2015.10); *A63B 21/4033* (2015.10); *A63B 22/001* (2013.01); *A63B 22/0664* (2013.01); *A63B 23/03541* (2013.01); *A63B 23/03575* (2013.01); *A63B 69/0057* (2013.01); *A61H 3/008* (2013.01); *A61H 2201/1269* (2013.01); *A61H 2201/163* (2013.01); *A61H 2201/1621* (2013.01); *A61H 2201/1635* (2013.01); *A61H 2201/1642* (2013.01); *A61H 2201/1676* (2013.01); *A63B 21/0058* (2013.01); *A63B 21/225* (2013.01); *A63B 21/4039* (2015.10); *A63B 22/14* (2013.01); *A63B 22/16* (2013.01); *A63B 22/203* (2013.01); *A63B 69/0064* (2013.01); *A63B 2022/0092* (2013.01); *A63B 2022/0094* (2013.01); *A63B 2022/067* (2013.01); *A63B 2208/0204* (2013.01); *A63B 2208/0233* (2013.01); *A63B 2209/10* (2013.01); *A63B 2225/093* (2013.01)

(58) Field of Classification Search

CPC ..... A63B 21/4009; A63B 21/4015; A63B 21/4011; A63B 21/4033; A63B 23/03541; A63B 23/03575; A63B 69/0064; A63B 22/14; A63B 22/203; A63B 22/16; A63B 2208/0233; A63B 2209/10; A63B 2022/067; A63B 2022/0094; A63B 21/225; A63B 2225/093; A63B 2208/0204; A63B 21/0058; A63B 2022/0092; A63B 21/4039; A61G 5/14; A61H 2201/1269; A61H 2201/1621; A61H 3/008; A61H 2201/1642; A61H 2201/1676; A61H 1/0262; A61H 2201/163; A61H 2201/1635

See application file for complete search history.

(56) References Cited

U.S. PATENT DOCUMENTS

| | | | | |
|---|---|---|---|---|
| 6,045,488 | A * | 4/2000 | Eschenbach | A63B 22/001 482/52 |
| 6,390,954 | B1 * | 5/2002 | Lee | A63B 22/001 482/51 |
| 6,440,046 | B1 * | 8/2002 | Tholkes | A61G 5/14 280/250.1 |
| 7,137,927 | B2 * | 11/2006 | Maresh | A63B 22/0007 482/52 |
| 7,494,448 | B2 * | 2/2009 | Eschenbach | A63B 22/001 482/51 |
| 7,507,185 | B2 * | 3/2009 | Eschenbach | A63B 22/001 482/52 |
| 7,611,446 | B2 * | 11/2009 | Chuang | A63B 22/0015 482/52 |
| 7,794,362 | B2 * | 9/2010 | Miller | A63B 22/0664 482/52 |
| 7,833,133 | B2 * | 11/2010 | Stewart | A63B 22/0017 482/52 |
| 7,993,247 | B1 * | 8/2011 | Eschenbach | A63B 22/001 482/52 |
| 8,062,190 | B2 * | 11/2011 | Pyles | A63B 22/0605 482/57 |
| 8,105,213 | B2 * | 1/2012 | Stewart | A63B 23/0429 482/52 |
| 8,303,470 | B2 * | 11/2012 | Stewart | A63B 22/0017 482/52 |
| 8,562,491 | B2 * | 10/2013 | Merli | A63B 23/03575 482/52 |
| 9,017,225 | B2 * | 4/2015 | Huang | A63B 22/001 482/62 |
| 9,044,639 | B2 * | 6/2015 | Chia | A63B 22/0605 |
| 9,050,485 | B2 * | 6/2015 | Huang | A63B 22/203 |
| 9,050,498 | B2 * | 6/2015 | Lu | A63B 22/0664 |
| 9,138,614 | B2 * | 9/2015 | Lu | A63B 21/154 |
| 9,248,071 | B1 * | 2/2016 | Benda | A63B 22/0664 |
| 9,498,696 | B1 | 11/2016 | Razon | |
| 9,616,282 | B2 * | 4/2017 | Tholkes | A63B 22/02 |
| 10,086,227 | B2 * | 10/2018 | Merli | A63B 22/0664 |
| 10,315,067 | B2 * | 6/2019 | Tholkes | A61B 5/4566 |
| 10,625,114 | B2 * | 4/2020 | Ercanbrack | A63B 22/0046 |
| 10,758,774 | B2 * | 9/2020 | Tholkes | A61H 1/0262 |
| 2004/0224825 | A1 * | 11/2004 | Giannelli | A63B 22/0023 482/52 |
| 2005/0202939 | A1 * | 9/2005 | Lull | A63B 22/0017 482/57 |
| 2006/0100065 | A1 * | 5/2006 | Maresh | A63B 22/0664 482/52 |
| 2007/0099764 | A1 * | 5/2007 | Eschenbach | A63B 22/0015 482/52 |
| 2007/0099766 | A1 * | 5/2007 | Pyles | A63B 22/0605 482/57 |
| 2007/0161463 | A1 * | 7/2007 | Eschenbach | A63B 22/0664 482/52 |
| 2008/0045385 | A1 * | 2/2008 | Eschenbach | A63B 22/0664 482/52 |
| 2008/0161164 | A1 * | 7/2008 | Stewart | A63B 22/001 482/52 |
| 2008/0261778 | A1 * | 10/2008 | Chuang | A63B 22/0664 482/52 |
| 2008/0287265 | A1 * | 11/2008 | Giannelli | A63B 22/001 482/52 |
| 2008/0312050 | A1 * | 12/2008 | Chuang | A63B 22/001 482/70 |
| 2009/0005222 | A1 * | 1/2009 | Liao | A63B 22/001 482/52 |
| 2009/0075786 | A1 * | 3/2009 | Merli | A63B 22/001 482/63 |
| 2009/0105049 | A1 * | 4/2009 | Miller | A63B 22/0664 482/52 |
| 2011/0028277 | A1 * | 2/2011 | Merli | A63B 21/154 482/63 |
| 2013/0053218 | A1 * | 2/2013 | Barker | G16H 20/30 482/4 |
| 2014/0051552 | A1 * | 2/2014 | Habing | A63B 22/0015 482/52 |
| 2014/0194256 | A1 * | 7/2014 | Huang | A63B 23/03591 482/52 |
| 2014/0243157 | A1 * | 8/2014 | Huang | A63B 22/203 482/52 |
| 2015/0141207 | A1 * | 5/2015 | Eschenbach | A63B 22/0076 482/52 |
| 2015/0165265 | A1 * | 6/2015 | Tholkes | A63B 23/03566 482/54 |
| 2015/1652650 | | 6/2015 | Tholkes et al. | |
| 2015/0246260 | A1 * | 9/2015 | Giannelli | A63B 22/0017 482/8 |
| 2017/0136295 | A1 * | 5/2017 | Tholkes | A61N 1/0484 |
| 2017/1971100 | | 7/2017 | Stelmach et al. | |
| 2018/0117393 | A1 * | 5/2018 | Ercanbrack | A63B 23/03575 |

* cited by examiner

ACTIVE ARM PASSIVE LEG EXERCISE MACHINE WITH GUIDED LEG MOVEMENT

This application claims the benefit under 35 U.S.C.119(e) of U.S. provisional application Ser. No. 62/652,947, filed Apr. 5, 2018.

FIELD OF THE INVENTION

The present invention relates to an exercise machine in which an active arm movement drives a passive leg movement of the user, and more particular, the present invention relates to an active arm passive leg exercise machine which supports the user in a manner which allows the user some freedom of movement within a prescribed range of various attachments of the user relative to a frame of the exercise machine.

BACKGROUND

Metabolic and cardiovascular (CV) outcomes after SCI are known to be dramatically inferior to the general population, leading to increased morbidity and reduced lifespans. People with SCI are also at greater risk of developing secondary medical problems, such as orthostatic hypotension (OH), decreased bone density, spasticity, bowel and bladder issues, and pain. People with other impairments and/or mobility limitations also experience many of these complications, including increased risk of chronic conditions such as obesity, reduced CV function, and diabetes.

Exercise has been shown to be beneficial for both promoting health and improving function, and even moderate levels of sustained activity has been shown to lessen physical decline and prevent or delay the onset of other chronic conditions. But while exercise is known to be beneficial, there is a dearth of sufficiently challenging, and functionally relevant equipment options for people with disabilities to use in both community and home settings. Typical exercise options for people with lower limb disabilities are usually limited to seated upper body exercise (e.g. arm-only wheeling, hand-cycling), which may ultimately provide an insufficient stimulus to prevent widespread CV health (e.g. in people with SCI). Furthermore, non-wheeling exercise options are recommended to mitigate chronic arm injury that occurs with repetitive wheelchair propulsion. Affordable exercise options that allow people with disabilities to train independently are required to support autonomy and long-term engagement, while promoting better health and function.

"Hybrid" exercise, in which passive leg exercise is combined with active arm exercise, represents a rarely explored area with clinical promise, which may lead to improved CV capacity, locomotor outcomes, and neuroplasticity for those with SCI. For this end-user population, research also points to beneficial effects on locomotor outcomes and secondary complications from combining weight bearing and gait training. For other disability groups, training devices that mimic over-ground gait have been shown to offer the specificity of muscle demands and joint motions desirable for restoring movement, gaining muscle strength, and building cardiovascular endurance necessary for walking. There is also an increasing amount of evidence showing that standing and locomotor gait training significantly benefits bone density, OH symptoms, neuropathic pain, and other secondary complications. Taken together, the evidence suggests that an upright standing therapy addressing CV fitness, bone density, OH tolerance, and synchronized arm-leg locomotor training would have widespread benefits. If this therapy can be realized in a single cost-effective machine that enables a person to perform multiple complementary therapies independently and efficiently, ample commercial opportunities are possible.

Commonly used machines for exercise and rehabilitation for people with lower limb mobility limitations fall into 4 broad categories. The first is robotic walking machines like the Ekso exoskeleton or Lokomat. These can effectively ambulate a user on a treadmill or overground, however, have little bearing on CV fitness and no arm-leg synchrony. Exoskeletons in particular are very speed limited, thus it may be difficult to get the therapy volume (i.e. reps) needed for locomotor outcomes. Further, while these may provide promising improvements in gait and function, their practical usage is limited as they are not widely available, are expensive, and require trained helpers to assist. The 2nd device category is adapted seated exercise machines for both arms and legs, like the NuStep (a recumbent stepping machine) or the SCIFIT "Total Body" (a seated arm-leg bike). These machines provide effective Active Arm Passive Leg Exercise (AAPLE) machines for better CV fitness outcomes, but have no capability for standing/walking motions, and thus do not confer the associated benefits. The third category is standing frames which provide weight bearing. One standing frame is the Easystand Glider. This "active" stander produces straight-leg reciprocal motions driven by the arms, to provide "lower body range of motion and upper body strengthening". But it does not provide the gait-like movements more appropriate for locomotor training, nor is it an effective CV exercise machine. The 4th category includes devices that aim to improve CV fitness through gait like motion. This new category would include the AAPLE-Walk, but currently contains only a single product—the ICARE (an elliptical-based, partial weight-supported gait rehabilitation machine). U.S. Pat. Nos. 8,007,405 and 8,177,688 by Madonna Rehabilitation Hospital et al disclose further examples of devices in this category. The devices in this category aim to address the limitations of existing exercise devices (e.g. affordability and independent access/use), but the machine does not provide controlled, guided leg motion and full standing support to make it a viable solution for people with complete SCI or other impairments with full lower limb paralysis.

SUMMARY OF THE INVENTION

According to one aspect of the invention there is provided an exercise machine comprising:

a main frame;

a torso support carried on the main frame so as to be arranged to support a torso of the user thereon facing in a forward direction;

a crank assembly supported on the main frame so as to be rotatable about a laterally oriented crank axis, the crank assembly including two crank members rotatable together at diametrically opposing locations relative to the crank axis and at laterally opposing sides of the crank assembly;

two base tracks on the main frame extending longitudinally in the forward direction below the torso support in which each base track supports a respective follower member for cyclical movement longitudinally along the base track;

two base link members, each base link member extending longitudinally from a first connection on a respective one of the crank members to a second connection on a respective one of the follower members such that the base link members are operatively connected to one another through the crank assembly to be 180 out of phase with one another;

two handles supported on the main frame for pivotal movement about a handle axis, each handle being operatively connected to a respective one of the base link members such that a cyclical movement of the handle drives the cyclical movement of the follower member of the respective base link member;

a foot support carried on each base link member for supporting a respective foot of the user thereon;

two leg linkages operatively connected between the main frame and respective ones of the base link members, wherein (i) each leg linkage includes an upper link and a lower link, (ii) each upper link is pivotally coupled at a first end of the upper link on the main frame adjacent the torso support, (iii) each lower link is pivotally coupled at a first end of the lower link on a second end of the upper link, and (iv) each lower link is pivotally coupled at a second end on the respective base link member adjacent the respective foot support; and bracing on each leg linkage to support a respective leg of the user relative to the leg linkage.

Preferably the torso support is arranged to support the torso of the user thereon in an upright walking orientation relative to the foot supports.

The torso support may comprise an abdominal binder arranged to extend about the torso of user.

The torso support may also comprise a flexible sling adapted to support buttocks of the user thereon.

The torso support may be movable relative to the main frame between a loading position at a first elevation arranged to support a user in the torso support in a seated position relative to the foot supports and a walking position at a second elevation spaced above the first elevation and arranged to support the user in the torso support in an upright walking configuration relative to the foot supports.

In this instance, the machine may further include a seating surface carried on the main frame in which the seating surface is movable between a seating position adapted to support a user seated thereon in the loading position of the torso support and a stored position in which the seating surface is displaced outwardly from the main frame relative to the seating position and does not interfere with the cyclical movement of the base link members and the corresponding walking configuration of the user.

In some embodiments, a portion of at least one of the leg linkages may be readily separated in a loading position of the leg linkage in which the leg linkage is discontinuous between the main frame and the base link member. In this instance, the first end of the upper link of said at least one leg linkage may be readily separable from the main frame into the loading position.

Each foot support may be pivotal relative to the respective base link member about a laterally oriented rocker axis. The rocker axis may be located spaced above a supporting surface upon which a foot of the user is to be received.

The torso support may also be supported on the main frame so as to be pivotal relative to the main frame one or more axes which are perpendicular to one another.

More particularly, the torso support is pivotal relative to the main frame about a lateral axis oriented perpendicularly to the forward direction, the lateral axis of the torso support being adjacent to a hip joint of a user. In this instance, the torso support may be supported on the main frame by a torso linkage so as to be pivotal relative to the main frame about said lateral axis within a prescribed range of movement defined by the torso linkage.

Alternatively, or in addition to the lateral axis, the torso support may be supported on the main frame by a torso linkage so as to be pivotal relative to the main frame about a tilt axis oriented in the forward direction within a prescribed range of movement defined by the torso linkage. In this instance, the tilt axis is preferably adjacent a bottom of the main frame.

Alternatively, or in addition to one or both of the lateral axis and the tilt axis, the torso support may be supported on the main frame by a torso linkage so as to be pivotal relative to the main frame about an upright axis within a prescribed range of movement defined by the torso linkage.

In some embodiments, the torso support may include a seating surface adapted to support the user thereon in a seated position while the base link members are moved cyclically with the feet of the user supported on the foot supports. In this instance, the torso support may be movable from the seated position to a walking position spaced above the seated position so as to be arranged to support the user in the torso support in an upright walking configuration relative to the foot supports, and the handles may be supported on the frame such that the handle axis is adjustable in height between respective seated and walking positions of the handles.

The machine may further include a motor operative connected to the crank assembly so as to be adapted to assist driving the cyclical movement of the base link members in addition to user input through the handles.

According to another important independent aspect of the present invention there is provided an exercise machine comprising:

a main frame;

a torso support carried on the main frame so as to be arranged to support a torso of the user thereon facing in a forward direction;

two base link members supported on the main frame such that each base link member is supported for cyclical movement relative to the main frame;

two handles supported on the main frame for pivotal movement about a handle axis, each handle being operatively connected to a respective one of the base link members such that a cyclical movement of the handle drives the cyclical movement of the respective base link member; and a foot support carried on each base link member for supporting a respective foot of the user thereon, the foot support is pivotal relative to the base link member about a laterally oriented rocker axis.

Preferably the rocker axis is located spaced above a supporting surface upon which a foot of the user is to be received.

According to another aspect of the present invention there is provided an exercise machine comprising:

a main frame;

two base link members supported on the main frame such that each base link member is supported for cyclical movement relative to the main frame;

two handles supported on the main frame for pivotal movement about a handle axis, each handle being operatively connected to a respective one of the base link members such that a cyclical movement of the handle drives the cyclical movement of the respective base link member;

a foot support carried on each base link member for supporting a respective foot of the user thereon; and a torso support on the main frame spaced above the base link members so as to be arranged to support a torso of the user thereon in an upright walking orientation relative to the foot supports and facing in a forward direction;

the torso support being supported on the main frame so as to be pivotal relative to the main frame about at least one axis.

According to another important independent aspect of the present invention there is provided an exercise machine comprising:

a main frame;

two base link members supported on the main frame such that each base link member is supported for cyclical movement relative to the main frame;

two handles supported on the main frame for pivotal movement about a handle axis, each handle being operatively connected to a respective one of the base link members such that a cyclical movement of the handle drives the cyclical movement of the respective base link member;

a foot support carried on each base link member for supporting a respective foot of the user thereon; and a torso support on the main frame spaced above the base link members so as to be arranged to support a torso of the user thereon in an upright walking orientation relative to the foot supports and facing in a forward direction;

the torso support being supported on the main frame so as to be pivotal relative to the main frame about a lateral axis oriented perpendicularly to the forward direction;

the lateral axis of the torso support being adjacent to a hip joint of a user.

Preferably the torso support is supported on the main frame by a torso linkage so as to be pivotal relative to the main frame about said lateral axis within a prescribed range of movement defined by the torso linkage.

According to another important independent aspect of the present invention there is provided an exercise machine comprising:

a main frame;

two base link members supported on the main frame such that each base link member is supported for cyclical movement relative to the main frame;

two handles supported on the main frame for pivotal movement about a handle axis, each handle being operatively connected to a respective one of the base link members such that a cyclical movement of the handle drives the cyclical movement of the respective base link member;

a foot support carried on each base link member for supporting a respective foot of the user thereon; and a torso support carried on the main frame spaced above the base link members so as to be arranged to support a torso of the user thereon in an upright walking orientation relative to the foot supports and facing in a forward direction;

the torso support being supported on the main frame by a torso linkage so as to be pivotal relative to the main frame about a tilt axis oriented in the forward direction within a prescribed range of movement defined by the torso linkage;

Preferably the tilt axis is adjacent a bottom of the main frame.

According to another important independent aspect of the present invention there is provided an exercise machine comprising:

a main frame;

two base link members supported on the main frame such that each base link member is supported for cyclical movement relative to the main frame;

two handles supported on the main frame for pivotal movement about a handle axis, each handle being operatively connected to a respective one of the base link members such that a cyclical movement of the handle drives the cyclical movement of the respective base link member;

a foot support carried on each base link member for supporting a respective foot of the user thereon; and a torso support on the main frame spaced above the base link members so as to be arranged to support a torso of the user thereon in an upright walking orientation relative to the foot supports and facing in a forward direction;

the torso support being supported on the main frame by a torso linkage so as to be pivotal relative to the main frame about an upright axis within a prescribed range of movement defined by the torso linkage.

According to another important independent aspect of the present invention there is provided an exercise machine comprising:

a main frame;

two base link members supported on the main frame such that each base link member is supported for cyclical movement relative to the main frame;

two handles supported on the main frame for pivotal movement about a handle axis, each handle being operatively connected to a respective one of the base link members such that a cyclical movement of the handle drives the cyclical movement of the respective base link member;

a foot support carried on each base link member for supporting a respective foot of the user thereon throughout a walking motion of the user as the base link members are moved cyclically;

a torso support on the main frame spaced above the base link members so as to be arranged to support a torso of the user thereon;

the torso support being movable relative to the main frame between a loading position at a first elevation arranged to support a user in the torso support in a seated position relative to the foot supports and a working position at a second elevation spaced above the first elevation and arranged to support the user in the torso support in an upright walking orientation relative to the foot support during the walking motion of the user as the base link members are moved cyclically; and a seating surface carried on the main frame, the seating surface being movable between a seating position adapted to support a user seated thereon in the loading position of the torso support and a stored position in which the seating surface is displaced outwardly from the main frame relative to the seating position and does not interfere with the cyclical movement of the base link members and the corresponding walking motion of the user.

In a preferred embodiment, the exercise machine according to the present invention includes: 1) an adjustable abdominal binder to stabilize the user, minimize OH risk, facilitate more efficient respiratory mechanics, and aid blood flow back to the heart; 2) a pivoting torso support to allow anterior/posterior tilt for comfort and change of position during exertion; 3) adjustable stride length to accommodate those with limited hip motion; 4) a padded sling under the buttocks to assist with joint alignment during standing; 5) pivoting foot supports that allow passive ankle motion, enabling usage by people with limited ankle range of motion; and 6) mechanisms for facilitated transfers including a large padded seat with break apart thigh sections to create an open transfer area, a quick connect mechanism for the break apart thigh section, and a seat that "gull-wings" out of the way to allow unimpeded leg motion while striding.

BRIEF DESCRIPTION OF THE DRAWINGS

Some embodiments of the invention will now be described in conjunction with the accompanying drawings in which.

In the drawings like characters of reference indicate corresponding parts in the different figures.

DETAILED DESCRIPTION

Figure 1:
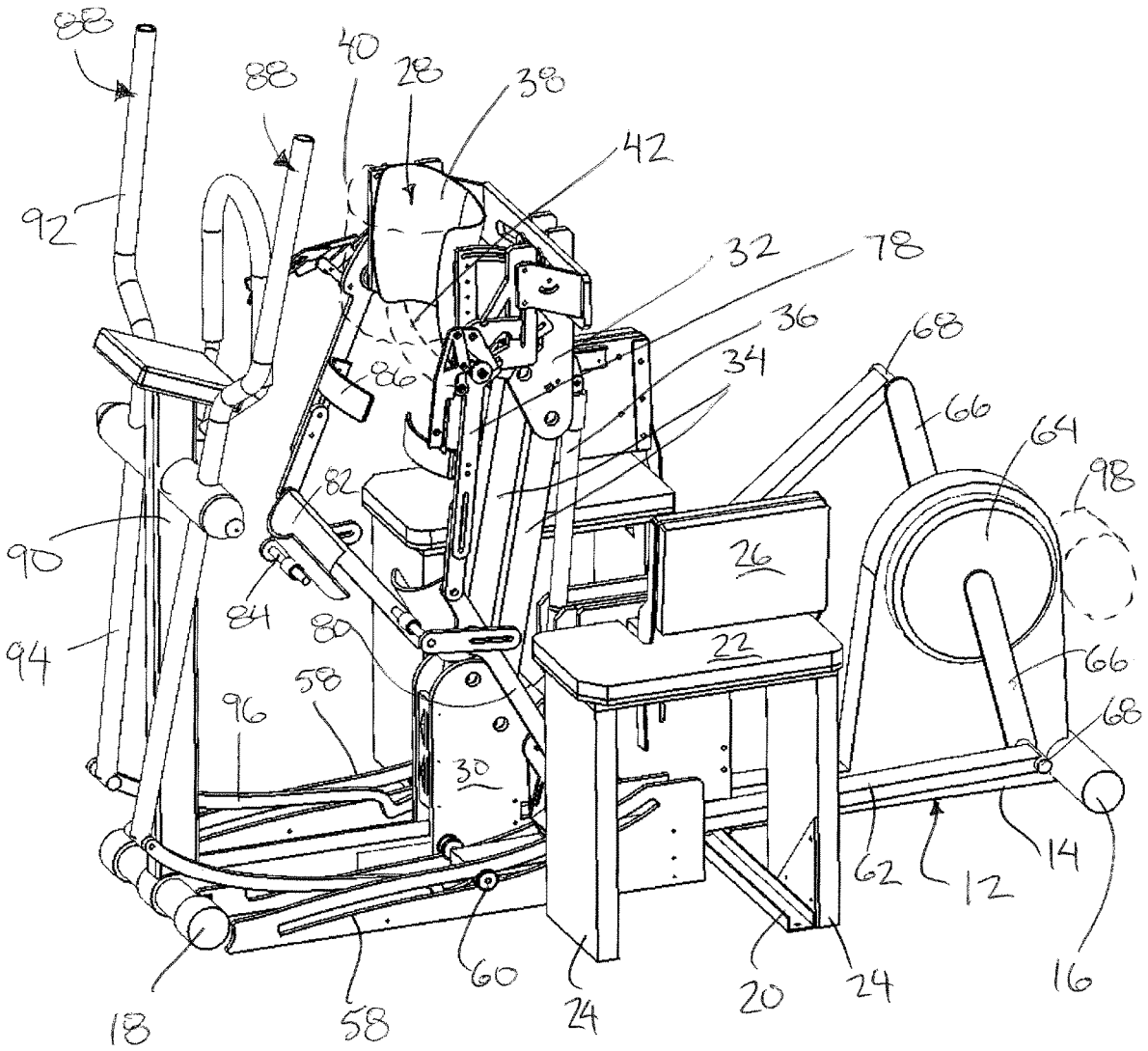
FIG. 1 is perspective view the exercise machine in a walking configuration showing a front and a left side of the machine.
Figure 2:
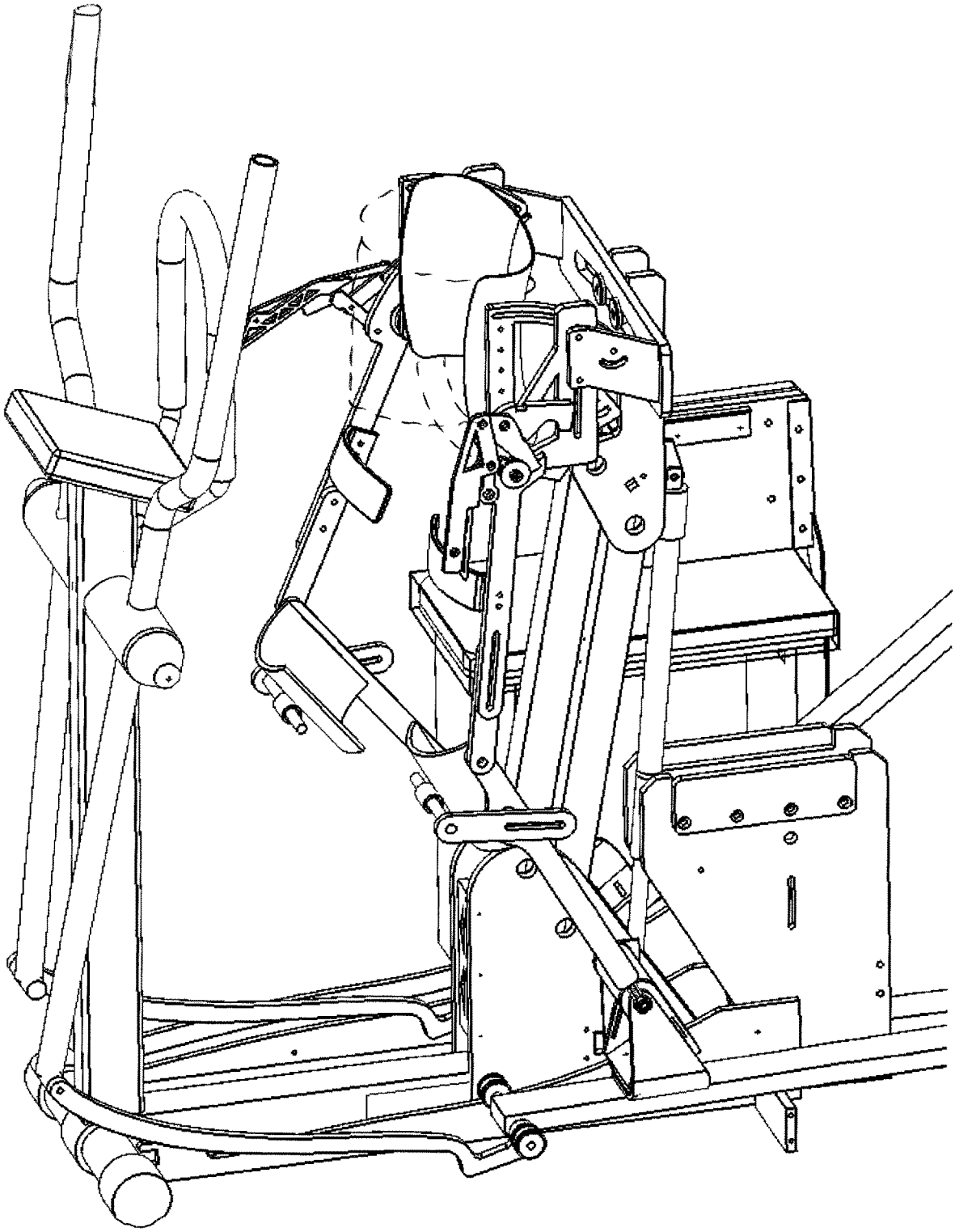
FIG. 2 is an enlarged portion of FIG. 1 in which some of the components of the exercise machine have been removed for illustrative purposes.
Figure 3:
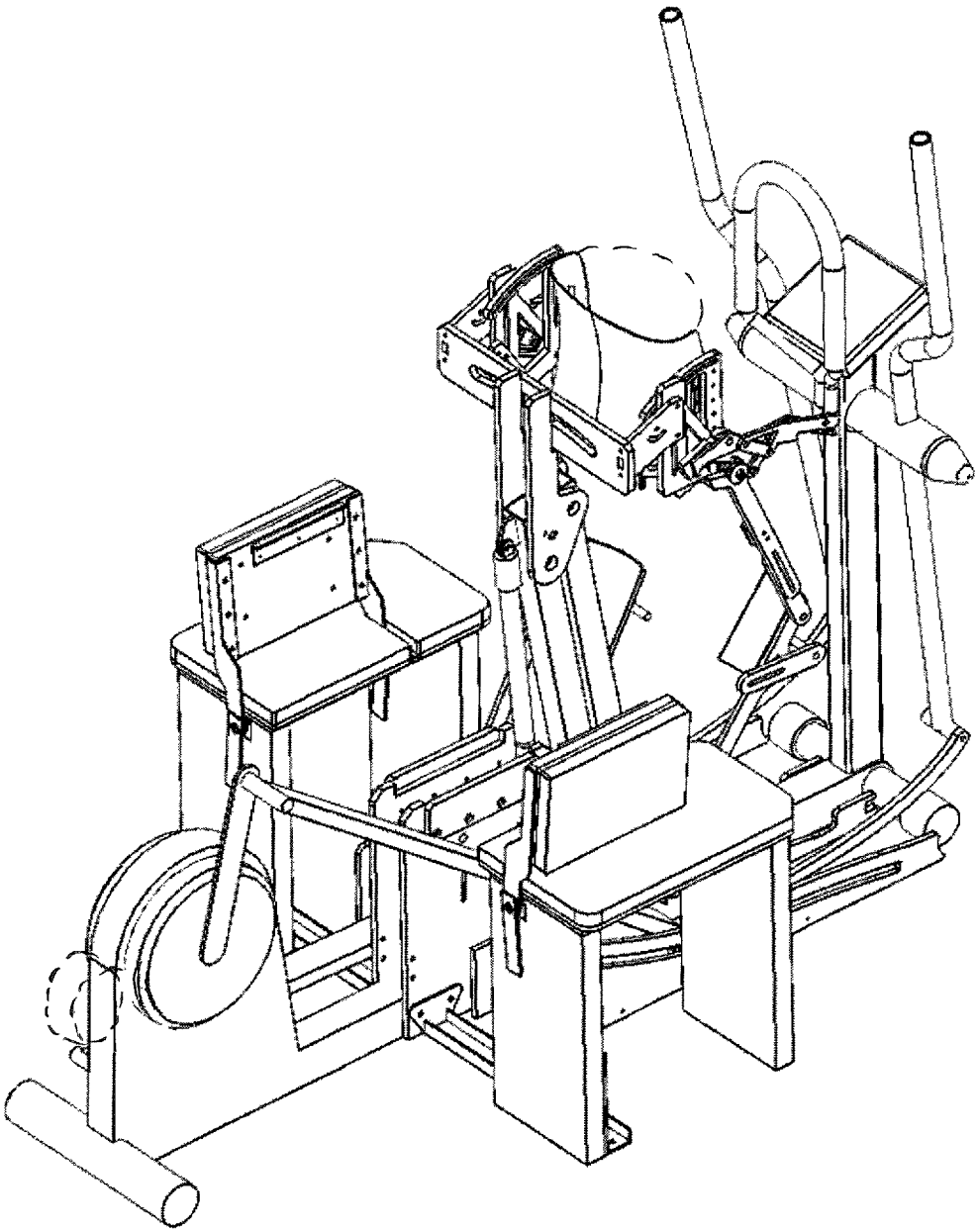
FIG. 3 is another perspective view of the exercise machine showing a rear and a right side of the machine.
Figure 4:
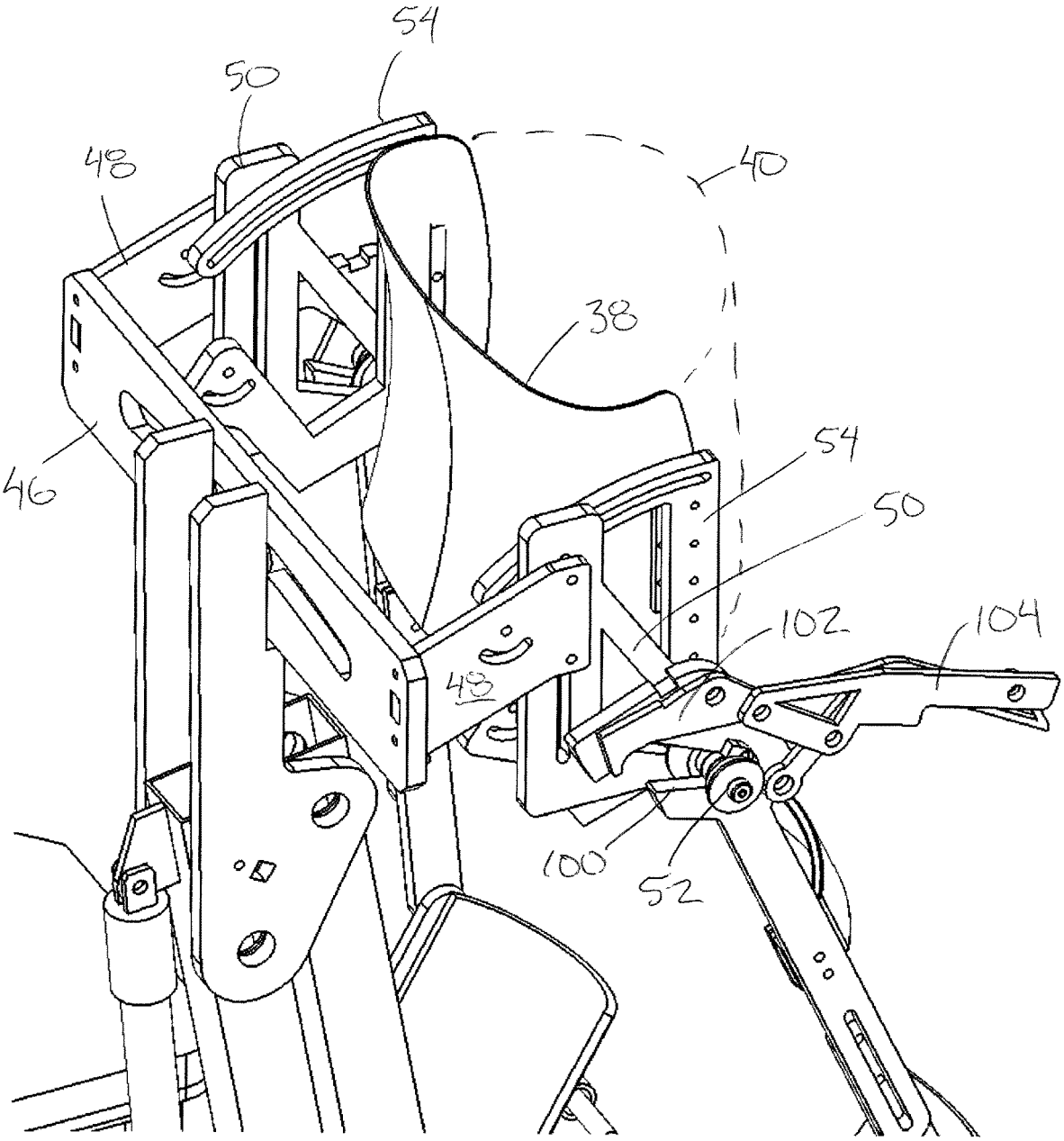
FIG. 4 is an enlarged portion of FIG. 3.
Figure 5:
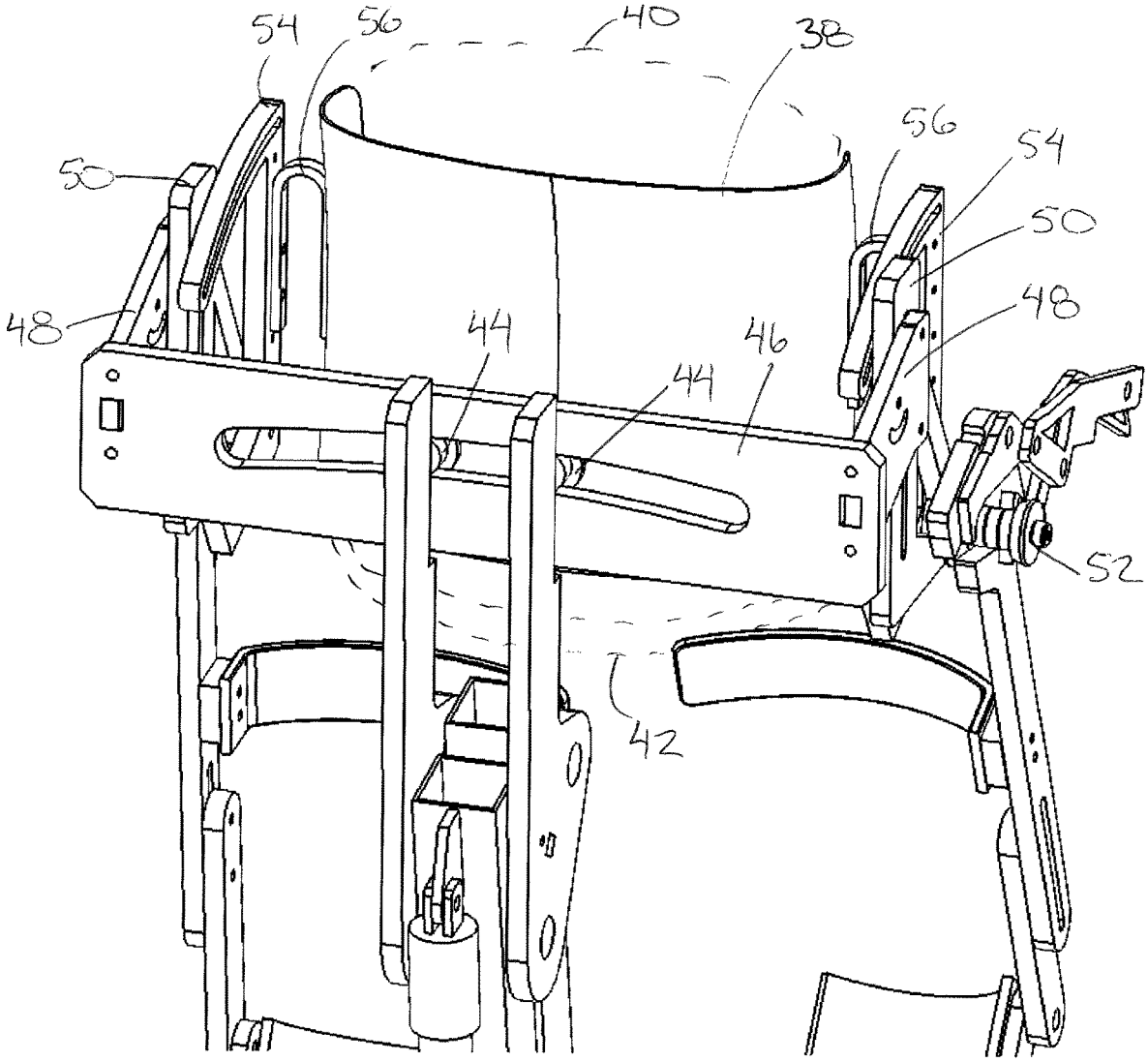
FIG. 5 is a perspective view of a rear of the torso support.
Figure 6:
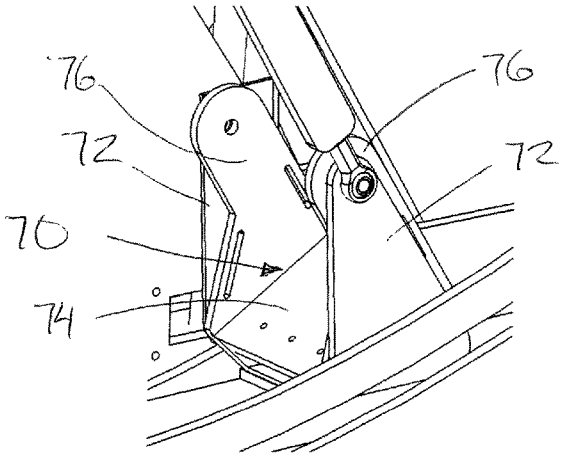
FIG. 6 is a perspective view of one of the foot supports.

Referring to the accompanying figures there is illustrated an exercise machine generally indicated by reference numeral 10. The machine 10 provides adequate support to the torso of a user to support the user in either a seated or standing position. The machine guides cyclical movements of the arms and the legs of the user in which the arm movements and leg movements are operatively connected. In this manner, the arms of the user may be moved actively while the legs of the user are moved passively in response to the arm movements, or alternatively the user may actively drive both arm and leg movements simultaneously with varying degrees of input provided by either the arms or the legs such that the exercise machine is suitable for use by a large number of different users having a variety of disabilities or injuries.

The machine 10 includes a main frame 12 for being supported on a suitable ground surface. The main frame includes a longitudinal beam 14 extending generally in a forward direction from a pair of laterally spaced apart feet 16 at the rear end of the beam and a pair of laterally spaced apart front feet 18 at the front end of the beam.

A seat frame is provided for supporting a user in a seated position thereon which is held in fixed relation to the main frame by a laterally oriented crossbar 20 protruding laterally outwardly from opposing sides of the beam 14. The seat frame includes two outer seat members 22, each defining a respective horizontal seating surface thereon at a suitable seating height at spaced apart positions on the outer sides of the main frame so as to be laterally opposed from one another. Each seat member 22 is supported on a pair of legs 24 in which one of the legs is fixed at a bottom end to the crossbar 20.

The space between the two outer seat members can be occupied by two inner seat members 26 which are pivotally supported on the respective outer seat members for movement between a seating position in which an upper surface of each inner seat member lies in a common plane with the upper seat surface of the outer seat members for receiving a user seated thereon, and an out-of-use position in which the inner seat members are each pivoted upwardly and laterally outwardly in relation to the seating position.

In the seating position the inner seat members support the user thereon as the user secures themselves relative to the machine however the seat is typically in a position of interference with the exercising motion of the user. In the out-of-use position, the inner seat members are pivoted laterally outwardly into an upright orientation spaced outwardly in relation to the inner edges of the outer seat members 22 so as to be in a non-interfering relationship with the exercising motion of the user secured within the exercising machine 10.

Even in the seating position, a small gap remains between the inner edges of the two inner seat members to accommodate a suitable linkage which displaces the user between sitting and standing positions as described in further detail below. Each inner seat member 26 is coupled to the respective outer seat member by a pair of pivot arms extending laterally outwardly from the inner seat member in the seating position to respective pivot mounting locations below the outer seat members respectively which define a pivot axis for each inner seat member which is oriented in the forward direction of the machine.

A torso support 28 is provided for receiving the torso of a user supported therein. The main frame includes a lift frame which supports the torso support 28 thereon such that the torso support is movable through a range of elevations including a seated position of the user, and an upright standing position of the user in which the user is supported for walking motion.

The lift frame includes a base frame portion 30 comprised of two parallel plates which are parallel and spaced apart from one another on opposing sides of the main beam 14 at a central location thereon to extend upwardly therefrom online parallel to the forward direction. A corresponding upper frame portion 32 that defines the upper end of the lift frame is also comprised of two parallel plates lying generally within respective common planes as the two plates of the base frame portion 30.

A pair of parallel link members 34 are coupled at opposing ends to the base frame portion and the upper frame portion respectively by being received between the corresponding parallel plates for pivotal movement about laterally oriented axes. In the seating position, the parallel links extend at an upward and rearward slope from the base frame portion to the upper frame portion. In the standing or walking position, the parallel links are nearer to vertical in orientation such that the torso support carried on the upper frame portion is raised to a second elevation above and forwardly of the location of the torso support in the seated position.

A lift cylinder 36 is operatively connected between the main frame and the upper frame portion such that linear extension and retraction of the list cylinder causes the lift frame to be displaced from the seating to the standing position thereof. The parallel links 34 and the lift cylinder 36 all lie within a generally common plane which is upright and oriented in the forward direction so as to be aligned with the gap between the inner edges of the inner seat members 26 in the seating position thereof. In this manner, the lift frame is operable between the seating and standing positions thereof while the inner seat members remained deployed in the seating position.

The torso support 28 is carried on the upper frame portion 32 of the lift frame of the main frame by a suitable torso linkage which supports the user for several degrees of freedom relative to the main frame. In particular, the torso linkage allows for some side to side tilting about a tilt axis oriented in the forward direction relative to the upper frame portion 32 of the lift frame, allows for some fore-aft tilting motion about a laterally oriented axis relative to the upper frame portion 32 of the lift frame, and/or allows for some twisting motion about a generally vertical axis relative to the upper frame portion of the lift frame.

The torso support 28 includes a rigid back plate 38 having a generally concave front surface suitable for conforming to the back of the user while spanning a lower back portion of the user. An abdominal binder 40 is provided in the form of a textile-based wrap which together with the rigid back plate 38 extend about the full circumference of the torso of the user across the length of the abdominal area from the hips to the rib cage of the user. The wrap may be a stiff material, or may be elasticized, but in either instance the material forming the binder is mounted under tension for tightly securing the torso of the user against of the back plate.

The torso support 28 also includes a flexible sling member 42 in the form of a padded and flexible band which is joined at opposing ends onto the opposing sides of the rigid back plate 38 respectively. The sling member 42 is suitably positioned for providing support beneath the buttocks of the user through a range of sitting and standing positions of the user. Alternatively, a rigid seat, for example similar to a bicycle seat, may provide a similar function while also not interfering with the walking motion during standing exercise movements.

Turning now more particularly to the torso linkage, the parallel plates of the upper frame portion 32 include two rollers 44 supported thereon at laterally spaced apart positions at a common elevation for rotation about respective axes oriented in the forward direction. A rear plate 46 includes an arcuate slot formed therein which receives the rollers 44 such that the rear plate 46 can be displaced laterally from side to side along an arc shaped path as defined by movement of the rollers 44 along the slot in the rear plate 46. The slot is curved to define a radius of curvature centred about the tilt axis oriented in the forward direction adjacent the bottom of the main frame. The slot within the rear plate 46 defines a prescribed range of side to side pivotal tilting movement about the tilt axis of the torso support 28 relative to the lift frame on the main frame.

Two arms 48 extend forwardly from laterally opposing sides of the rear plate 46 upon which are fastened a pair of side plates 50 respectively. The side plates 50 include suitable slots formed therein for alignment with fastener apertures in the two arms such that the side plates can be fastened through a range of heights relative to the arms 48 which in turn allows the torso support to be adjusted through a range of heights relative to the lift frame. The side plates 50 support a pair of pivot shafts 52 thereon respectively which protrude laterally outwardly from opposing sides of the torso support for alignment with a common hip axis of the user supported in the torso support. Each pivot shaft 52 provides a pivotal connection to a respective leg linkage described in further detail below.

The torso linkage which supports the torso support on the upper frame portion 32 of the lift frame further includes two pivot plates 54 supported at the inner sides of the two side plates 50 respectively. The pivot plates 54 include arcuate shaped slots formed therein for cooperation with respective fasteners protruding inwardly from the side plates 50 in which the slots in the pivot plates have a radius of curvature centred at the hip axis defined by the pivot shaft 52. In this manner the pivot plate 54 are pivotal about a common lateral axis within a prescribed range defined by the slots.

A pair of coupling members 56 are connected at opposing sides of the back plate 38 of the torso support for connection to the pair of pivot plates 54. The coupling members 56 may define a rigid connection of the torso support to the pivot plates 54, or may include sliders movable along curved tracks in which the tracks are centred about a common upright axis which allows the torso support 28 to twist about the upright axis relative to the remainder of the torso linkage supported on the upper frame portion 32 of the lift frame.

The machine 10 further includes two base tracks 58 which are supported at laterally opposing sides of the main beam 14 to each extend generally in the forward direction from respective rear ends below the seat frame and the torso support thereabove to respective front ends adjacent the front end of the main frame. The tracks are sloped generally downwardly and forwardly from the rear ends to the forward ends thereof. The tracks are shaped such that a rear portion of each track is concave at the upper side thereof while being convex at the upper side thereof towards a forward portion of the track. Each track is defined by a pair of parallel upright plates which are laterally spaced apart and which each include a slot formed therein which defines the path of the track.

A follower 60 is supported on each track in the form of a laterally oriented axle having a pair of rollers at opposing ends thereof which are received within the slots of the two plates forming the respective track. The rollers are supported for cyclical movement forward and backward along the track.

The machine further includes two base link members 62 coupled at respective forward ends onto respective ones of the followers 60 of the two tracks. The base link members 62 are pivotally coupled to the followers at the front end thereof while being coupled to one another through a crank assembly at the rear ends thereof as described in further detail below.

The crank assembly includes a flywheel member 64 supported at the rear end of the frame so as to be spaced rearwardly of the seat frame and the torso support. The flywheel is rotatable about a lateral axis. Two crank arms 66 are coupled to the flywheel at axially or at laterally opposing sides of the flywheel as well as being diametrically opposite one another so as to be 180° out of phase with one another throughout the rotation of the flywheel. Each crank arm supports a pivot shaft 68 thereon at a common radius spaced outwardly from the axis of rotation of the flywheel. The rear ends of the base link members 62 are pivotally coupled to the pivot shafts 68 respectively. In this manner the base link members 62 are operatively connected to one another through the crank assembly such that movements of the followers 60 along the respective tracks remain 180° out of phase with one another.

A pair of foot supports 70 are carried on the two base link members 62 respectively. In this regard each base link member 62 includes a pair of support plates 72 which are parallel and spaced apart at opposing sides of the base link member to extend upwardly therefrom while being oriented in the forward direction. Each foot support 70 is received between the respective pair of support plates 72. The foot supports each include a base plate 74 defining an upper supporting surface for receiving the foot of a user supported thereon. A pair of side plates 76 extend upwardly from opposing sides of the base plate 74 to be received alongside the inner surfaces of the respective pair of support plates 72. The side plates 76 and the base plate 74 are thus generally U-shaped for receiving the foot of the user between the two side plates 76. The side plates are joined by pivotal connection to the pair of support plates 72 respectively to define a common rocker axis oriented in the lateral direction about which the foot support is pivotal relative to the support plate 72 and the base link member 62 upon which it is supported. The rocker axis in this instance is located spaced above the supporting surface of the base plate 74 to provide a pendulum-like support to the foot of the user.

A leg linkage is provided for connection between each pivot shaft 52 of the torso support and a respective one of the base link members 62 for guiding movement of a respective one of the legs of the user through a walking motion. More particularly each leg linkage includes an upper link 78 pivotally connected at an upper end on the respective pivot shaft 52 while being adjustable in length between the upper end and an opposing bottom end thereof. Each leg linkage also includes a lower link 80 which is pivotally connected at a top end onto the bottom end of the corresponding upper link while being pivotally connected at an opposing bottom end onto one of the support plates 72 of a respective base link member 62 at the location of the rocker axis.

Each leg linkage includes suitable bracing incorporated therein for guiding movement of the leg of the user. The bracing includes a knee cup 82 having a concave inner supporting surface for receiving the knee of the user therein. A suitable pivot shaft 84 defines a lateral pivot axis at the front side of the knee cup about which the knee cup is pivotal relative to the lower link member upon which the pivot shaft 84 is supported. A suitable adjustable mounting member is provided for adjusting the position of the pivot shaft 84 relative to the lower link to assist in aligning the knee cup with a knee joint of the user.

The bracing of each leg linkage also includes a thigh cup 86 having a concave inner surface for extending over a front side of a thigh of the user at an intermediate location there along between the knee and hip joints of the user. The thigh cap 86 protrudes inwardly from an outer end fixed onto an inner surface of the upper link of the leg linkage such that the upper and lower links of the leg linkage extend along the outer side of the leg of the user supported within the torso support. Straps (not shown) are used to wrap around each upper and lower leg of the user to secure the user to left and right knee cups 82 and thigh cups 86, for instance with Velcro or another attachment means.

The machine 10 also includes a pair of handles 88 which are carried on a front post 90 extending upwardly from the front end of the main beam 14 of the frame. The handles are independently pivotal about a common pivot axis oriented in the lateral direction. An upper portion 92 of each handle which extends upwardly from the pivot axis is suitably positioned for being grasped in the hands of the user supported within the torso support. A diametrically opposed lower portion 94 of each handle extends downwardly from the pivot axis of the handle for operative connection to a respective one of the base link members. More particularly a handle link member 96 is provided which is pivotally coupled at a forward end at the bottom end of each handle 88 while being pivotally connected at a rear end to the front end of the respective base link member 62 adjacent the respective follower thereof.

The handles 88 are operatively connected to one another through the base link members 62 which are in turn coupled to one another through the crank assembly such that the handles are also maintained 180° out of phase with one another as they are displaced in a rocking motion about the pivot axis in a cyclical movement. More particularly a forward and back cyclical movement of the top ends of the handles 88 grasped by the hands of the user drives a corresponding cyclical movement of the foot supports along their respective tracks.

An optional motor 98 can be operatively connected to the flywheel to assist in driving the cyclical movement of the foot supports and the handles. Accordingly, the exercise machine can be operated in a first mode in which the hands of the user provide the only input to drive the cyclical movement of the foot supports and the leg linkages to drive the motion of the legs of the user in a walking configuration. Alternatively, the user can maintain some input with arm movement driving the cyclical movement of the handles but the motor is also activated to assist in driving the cyclical movement of the foot supports to drive the walking motion of the legs of the user. In further arrangements, any combination of arm movements of the user, leg movements of the user and motor inputs may be used to drive the cyclical motion of the exercise machine.

Figure 7:
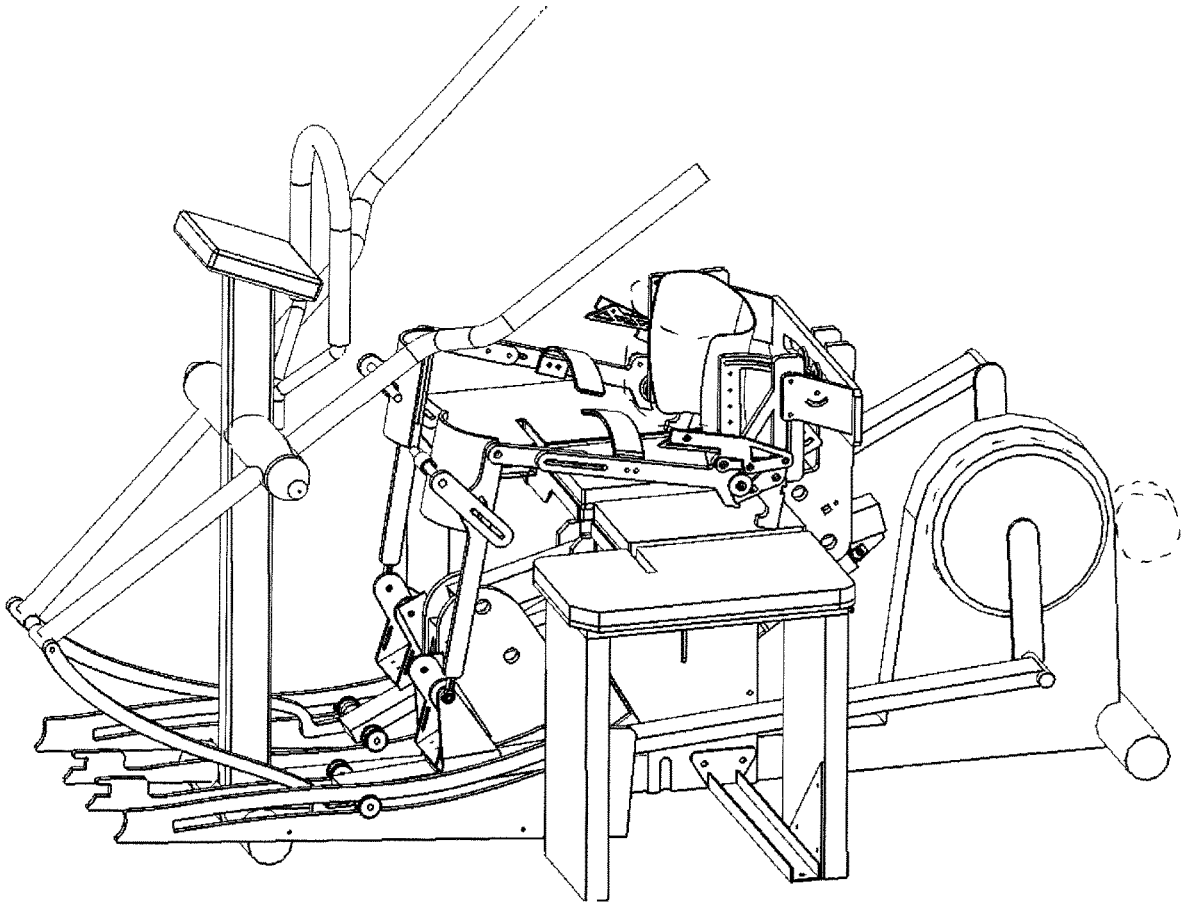
FIG. 7 is a perspective view of the exercise machine in a seated configuration.

The machine is typically operated in a walking configuration as shown in FIG. 1, however the machine can also be readily configured in a seated configuration as shown in FIG. 7. This can be accomplished using the same machine with adjustments being provided to adjust the height of the pivot axis of the handles along the front post 90 as well as adjusting the location along the handles for connection to the pivots on the front post. Further adjustments can be provided for displacing the tracks forwardly relative to the remainder of the main frame, or alternatively the seat frame and the lift frame supporting the torso support can be displaced rearwardly along the main frame relative to the tracks. In either instance the position of a user seated on the seating surfaces relative to the leg linkages and base tracks is such that the seat does not interfere with cyclical movement of the leg linkages through the complete range of motion for performing exercise while the seat remains in the loading position with the user seated thereon.

To assist transfer of a user onto the machine, one or both leg linkages can be releasable into a loading position in which the leg linkage is discontinuous between the lower pivot on the respective base link member and the upper pivot on the torso support. In the illustrated embodiment, the top end of the upper link of each leg linkage is releasable from the pivot shaft 52. This is accomplished by providing a slot 100 in the upper link receiving the pivot shaft 52 therein which cooperates with a latch member 102 movable between a released position enabling the pivot shaft to be released from the slot and a latched position in which the pivot shaft is retained within the slot so that the upper link is constrained to pivotal motion about the pivot shaft. A suitable lever 104 is provided with suitable pivotal connections relative to the structure supporting the pivot shaft 52 thereon and relative to the latch 102 such that the lever must be pivoted over-centre between released and latched positions of the latch 102.

In order for a user to exercise with the machine 10, the inner seat members are initially positioned in the loading position and the lift frame is lowered to the seating position. By releasing one of the leg linkages, a user can be readily transferred from an adjacent structure, such as a wheelchair, onto the corresponding outer seat member, followed by sliding or lifting themselves along the seating surfaces of the seat frame to a central location on the inner seat members. The leg linkage can be reconnected so that the user can be secured within the torso support and the leg linkages with their feet engaged upon the upper supporting surfaces of the foot supports respectively. Similarly, the knee cups and thigh cups are engaged with the user's lower and upper legs respectively.

If configured in the seating configuration of FIG. 7, the user may initiate arm movements to drive the cyclical motion of the machine which in turn drives the reciprocating movement of the foot supports together with guided movement of the legs by the leg linkages.

If it is desired to use the machine in the walking configuration of FIG. 1, the user would then actuate the lift frame to elevate the torso support from the seated position to a standing orientation at a greater elevation than the seated position. The inner seat members can then be lifted upwardly and outwardly into the stored position thereof. The user can then initiate arm movements to drive the cyclical motion of the handles and the corresponding cyclical movement of the leg linkages and foot supports to drive leg movement of the user through a walking motion.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. An exercise machine comprising:

a main frame;

a torso support carried on the main frame so as to be arranged to support a torso of the user thereon facing in a forward direction;

a crank assembly supported on the main frame so as to be rotatable about a laterally oriented crank axis, the crank assembly including two crank members rotatable together at diametrically opposing locations relative to the crank axis and at laterally opposing sides of the crank assembly;

two base tracks on the main frame extending longitudinally in the forward direction below the torso support in which each base track supports a respective follower member for cyclical movement longitudinally along the base track;

two base link members, each base link member extending longitudinally from a first connection on a respective one of the crank members to a second connection on a respective one of the follower members such that the base link members are operatively connected to one another through the crank assembly to be 180 out of phase with one another;

two handles supported on the main frame for pivotal movement about a handle axis, each handle being operatively connected to a respective one of the base link members such that a cyclical movement of the handle drives the cyclical movement of the follower member of the respective base link member;

a foot support carried on each base link member for supporting a respective foot of the user thereon;

two leg linkages operatively connected between the main frame and respective ones of the base link members, wherein (i) each leg linkage includes an upper link and a lower link, (ii) each upper link is pivotally coupled at a first end of the upper link on the main frame adjacent the torso support, (iii) each lower link is pivotally coupled at a first end of the lower link on a second end of the upper link, and (iv) each lower link is pivotally coupled at a second end on the respective base link member adjacent the respective foot support; and bracing on each leg linkage to support a respective leg of the user relative to the leg linkage.

2. The machine according to claim 1 wherein the torso support is arranged to support the torso of the user thereon in an upright walking orientation relative to the foot supports.

3. The machine according to claim 1 wherein the torso support comprises an abdominal binder arranged to extend about the torso of user.

4. The machine according to claim 1 wherein the torso support comprises a flexible sling adapted to support buttocks of the user thereon.

5. The machine according to claim 1 wherein the torso support is movable relative to the main frame between a loading position at a first elevation arranged to support a user in the torso support in a seated position relative to the foot supports and a walking position at a second elevation spaced above the first elevation and arranged to support the user in the torso support in an upright walking configuration relative to the foot supports.

6. The machine according to claim 5 further comprising a seating surface carried on the main frame, the seating surface being movable between a seating position adapted to support a user seated thereon in the loading position of the torso support and a stored position in which the seating surface is displaced outwardly from the main frame relative to the seating position and does not interfere with the cyclical movement of the base link members and the corresponding walking configuration of the user.

7. The machine according to claim 5 wherein a portion of at least one of the leg linkages can be readily separated in a loading position of the leg linkage in which the leg linkage is discontinuous between the main frame and the base link member.

8. The machine according to claim 1 wherein each foot support is pivotal relative to the respective base link member about a laterally oriented rocker axis.

9. The machine according to claim 8 wherein the rocker axis is located spaced above a supporting surface upon which a foot of the user is to be received.

10. The machine according to claim 1 wherein the torso support is supported on the main frame so as to be pivotal relative to the main frame about a lateral axis oriented perpendicularly to the forward direction, the lateral axis of the torso support being adjacent to a hip joint of a user.

11. The machine according to claim 10 wherein the torso support is supported on the main frame by a torso linkage so as to be pivotal relative to the main frame about said lateral axis within a prescribed range of movement defined by the torso linkage.

12. The machine according to claim 1 wherein the torso support is supported on the main frame by a torso linkage so as to be pivotal relative to the main frame about a tilt axis oriented in the forward direction within a prescribed range of movement defined by the torso linkage.

13. The machine according to claim 12 wherein the tilt axis is adjacent a bottom of the main frame.

14. The machine according to claim 1 wherein the torso support is supported on the main frame by a torso linkage so as to be pivotal relative to the main frame about an upright axis within a prescribed range of movement defined by the torso linkage.

15. The machine according to claim 1 wherein the torso support includes a seating surface adapted to support the user thereon in a seated position while the base link members are moved cyclically with the feet of the user supported on the foot supports.

16. The machine according to claim 15 wherein the torso support is movable from the seated position to a walking position spaced above the seated position so as to be arranged to support the user in the torso support in an upright walking configuration relative to the foot supports, and wherein the handles are supported on the frame such that the handle axis is adjustable in height between respective seated and walking positions of the handles.

17. The machine according claim 1 further comprising a motor operative connected to the crank assembly so as to be adapted to assist driving the cyclical movement of the base link members in addition to user input through the handles.

18. An exercise machine comprising:

a main frame;

a torso support carried on the main frame so as to be arranged to support a torso of the user thereon facing in a forward direction;

two base link members supported on the main frame such that each base link member is supported for cyclical movement relative to the main frame;

two handles supported on the main frame for pivotal movement about a handle axis, each handle being operatively connected to a respective one of the base link members such that a cyclical movement of the handle drives the cyclical movement of the respective base link member;

two leg linkages operatively connected between the main frame and respective ones of the base link members, wherein (i) each leg linkage includes an upper link and a lower link, (ii) each upper link is pivotally coupled at a first end of the upper link on the main frame adjacent the torso support, (iii) each lower link is pivotally coupled at a first end of the lower link on a second end of the upper link, and (iv) each lower link is pivotally coupled at a second end on the respective base link member adjacent the respective foot support; and a foot support carried on each base link member for supporting a respective foot of the user thereon, the foot support being pivotal relative to the base link member about a laterally oriented rocker axis independently of a pivotal motion of the lower link of the respective leg linkage relative to the base link member.

19. The machine according to claim 18 wherein the rocker axis is located spaced above a supporting surface upon which a foot of the user is to be received.

20. An exercise machine comprising:

a main frame;

two base link members supported on the main frame such that each base link member is supported for cyclical movement relative to the main frame;

two handles supported on the main frame for pivotal movement about a handle axis, each handle being operatively connected to a respective one of the base link members such that a cyclical movement of the handle drives the cyclical movement of the respective base link member;

a foot support carried on each base link member for supporting a respective foot of the user thereon; and a torso support on the main frame spaced above the base link members so as to be arranged to support a torso of the user thereon in an upright walking orientation relative to the foot supports and facing in a forward direction;

a torso linkage supporting the torso support on the main frame such that the torso support is pivotal relative to the main frame about at least one axis within a prescribed range of movement defined by the torso linkage while the torso support continues to support the user thereon in the upright walking orientation.

21. The exercise machine according to claim 20 wherein said at least one axis includes a lateral axis oriented perpendicularly to the forward direction, the lateral axis of the torso support being adjacent to a hip joint of a user.

22. The exercise machine according to claim 20 wherein said at least one axis includes a tilt axis oriented in the forward direction.

23. The machine according to claim 22 wherein the tilt axis is adjacent a bottom of the main frame.

24. The exercise machine according to claim 20 wherein said at least one axis includes an upright axis that is upright in orientation.

* * * * *